US006220927B1

(12) United States Patent
Mizuno et al.

(10) Patent No.: US 6,220,927 B1
(45) Date of Patent: Apr. 24, 2001

(54) LENS GRINDING APPARATUS

(75) Inventors: Toshiaki Mizuno, Gamagori; Hirokatsu Obayashi, Aichi, both of (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 09/197,574

(22) Filed: Nov. 23, 1998

(30) Foreign Application Priority Data

Nov. 21, 1997 (JP) ..... 9-337995
Nov. 21, 1997 (JP) ..... 9-337996

(51) Int. Cl.[7] ..... B24B 49/00

(52) U.S. Cl. ..... 451/5; 451/10; 451/65; 451/195; 451/209; 451/210; 451/255; 451/256

(58) Field of Search ..... 451/5, 21, 43, 451/44, 57, 65, 195, 197, 209, 210, 255, 256, 10

(56) References Cited

U.S. PATENT DOCUMENTS

| | | | | |
|---|---|---|---|---|
| 1,521,116 | * | 12/1924 | Miller | 451/210 X |
| 3,158,967 | * | 12/1964 | Reaser | 451/43 |
| 5,056,270 | * | 10/1991 | Curcher | 451/43 |
| 5,097,630 | * | 3/1992 | Maeda et al. | 451/210 X |
| 5,127,210 | * | 7/1992 | Dunbar | 451/209 X |
| 5,138,770 | | 8/1992 | Matsuyama . | |
| 5,148,637 | * | 9/1992 | Byron | 451/43 X |
| 5,228,242 | | 7/1993 | Matsuyama . | |
| 5,333,412 | | 8/1994 | Matsuyama . | |
| 5,347,762 | | 9/1994 | Shibata et al. . | |
| 5,484,327 | * | 1/1996 | Kovach | 451/209 X |
| 5,643,052 | * | 7/1997 | Delattre et al. | 451/43 X |
| 5,658,189 | * | 8/1997 | Kagamida | 451/210 X |
| 5,711,700 | | 1/1998 | Raffaelli . | |
| 5,716,256 | * | 2/1998 | Mizuno et al. | 451/43 X |
| 5,727,987 | * | 3/1998 | Gottschlad | 451/43 X |
| 5,738,563 | * | 4/1998 | Shibata | 451/43 X |

FOREIGN PATENT DOCUMENTS

| | | |
|---|---|---|
| 3-20603 | 1/1991 | (JP) . |
| 8-39410 | 2/1996 | (JP) . |
| 9-29597 | 2/1997 | (JP) . |

* cited by examiner

*Primary Examiner*—Timothy V. Eley
(74) *Attorney, Agent, or Firm*—Sughrue, Mion, Zinn, Macpeak & Seas, PLLC

(57) ABSTRACT

An eyeglass lens grinding apparatus is used for processing an eyeglass lens based on processing data obtained from target lens configuration data indicative of an eyeglass frame shape. In the eyeglass lens grinding apparatus, a lens is rotated while being subjected to processing by a grinding wheel group. The grinding wheel group has intermediate and accurate finishing processing wheels respectively formed with a plurality of beveling groove each for forming a bevel on a periphery of a lens. The intermediate and accurate finishing processing wheels are controlled to finish the lens by selectively and consecutively using the beveling grooves.

16 Claims, 9 Drawing Sheets

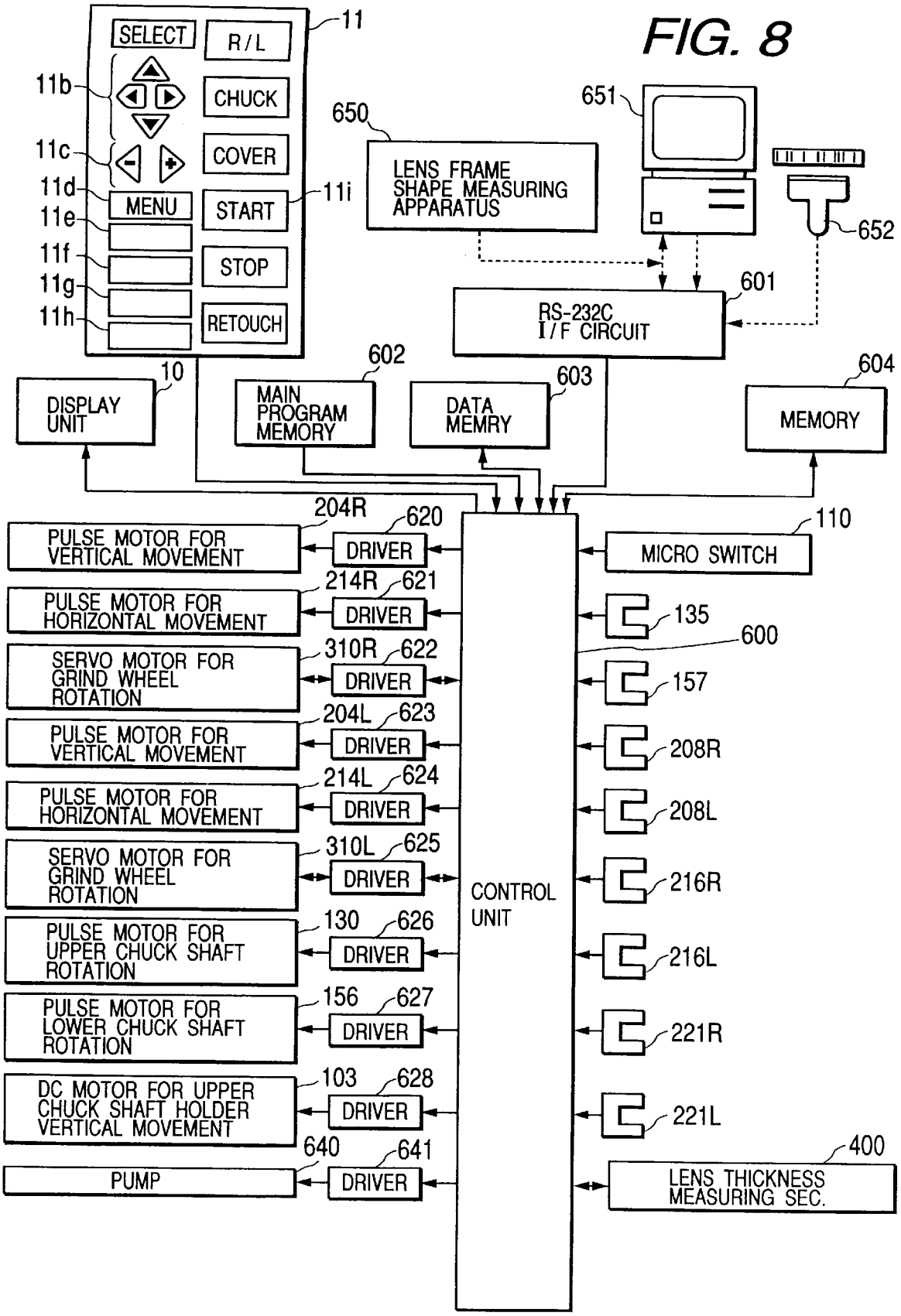
FIG. 8
SELECT
R/L
CHUCK
COVER
MENU
START
STOP
RETOUCH
11
11b
11c
11d
11e
11f
11g
11h
11i
650
LENS FRAME SHAPE MEASURING APPARATUS
651
652
601
RS-232C I/F CIRCUIT
10
DISPLAY UNIT
602
MAIN PROGRAM MEMORY
603
DATA MEMRY
604
MEMORY
204R
620
PULSE MOTOR FOR VERTICAL MOVEMENT
DRIVER
214R
621
PULSE MOTOR FOR HORIZONTAL MOVEMENT
DRIVER
310R
622
SERVO MOTOR FOR GRIND WHEEL ROTATION
DRIVER
204L
623
PULSE MOTOR FOR VERTICAL MOVEMENT
DRIVER
214L
624
PULSE MOTOR FOR HORIZONTAL MOVEMENT
DRIVER
310L
625
SERVO MOTOR FOR GRIND WHEEL ROTATION
DRIVER
130
626
PULSE MOTOR FOR UPPER CHUCK SHAFT ROTATION
DRIVER
156
627
PULSE MOTOR FOR LOWER CHUCK SHAFT ROTATION
DRIVER
103
628
DC MOTOR FOR UPPER CHUCK SHAFT HOLDER VERTICAL MOVEMENT
DRIVER
640
641
PUMP
DRIVER
CONTROL UNIT
110
MICRO SWITCH
135
600
157
208R
208L
216R
216L
221R
221L
400
LENS THICKNESS MEASURING SEC.

FIG. 9

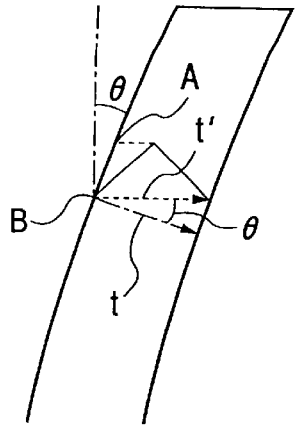

FIG. 10

701

700

| PARAMETER | |
|---|---|
| ⇨ 1. SIZE ADJUSTMENT, I.F.P. BEVEL 1 | +0.200 |
| 2. SIZE ADJUSTMENT, I.F.P. BEVEL 2 | +0.100 |
| 3. SIZE ADJUSTMENT, I.F.P. BEVEL 3 | +0.100 |
| 4. SIZE ADJUSTMENT, I.F.P. BEVEL 4 | +0.100 |
| 5. SIZE ADJUSTMENT, A.F.P. BEVEL 1 | +0.100 |
| 6. SIZE ADJUSTMENT, A.F.P. BEVEL 2 | 0.000 |
| 7. SIZE ADJUSTMENT, A.F.P. BEVEL 3 | 0.000 |
| 8. SIZE ADJUSTMENT, A.F.P. BEVEL 4 | 0.000 |
| 9. POSITION ADJUSTMENT, I.F.P. BEVEL 1 | 0.000 |
| 10. POSITION ADJUSTMENT, I.F.P. BEVEL 2 | 0.000 |
| 11. POSITION ADJUSTMENT, I.F.P. BEVEL 3 | 0.000 |
| 12. POSITION ADJUSTMENT, I.F.P. BEVEL 4 | 0.000 |
| 13. POSITION ADJUSTMENT, A.F.P. BEVEL 1 | 0.000 |
| 14. POSITION ADJUSTMENT, A.F.P. BEVEL 2 | 0.000 |
| 15. POSITION ADJUSTMENT, A.F.P. BEVEL 3 | 0.000 |
| 16. POSITION ADJUSTMENT, A.F.P. BEVEL 4 | 0.000 |

LENS GRINDING APPARATUS

BACKGROUND OF THE INVENTION

The present invention relates to an eyeglass lens grinding apparatus which grinds a lens to be processed, so that the lens fits into an eyeglass frame.

An eyeglass lens grinding apparatus is known, which has a rough grinding wheel having a particle size of about # 100 to # 120 depending on the material of a lens to be processed, and a finishing grinding wheel having a particle size of about #400. These rough grinding and finishing grinding wheels are coaxially mounted on a grinding wheel rotary shaft. The finishing grinding wheel is provided with a single bevel groove. In the lens grinding apparatus, the lens to be processed is held on the lens rotary shaft, and pressingly contacted with the grinding wheels so that a bevel is finally formed in a peripheral portion of the lens. That is, the lens is roughly processed by the rough grinding wheel and then processed by the finishing grinding wheel having the bevel groove, into a final shape in which the lens fits into an eyeglass frame.

When the number of lenses to be processed is large, the degree of wear of a grinding wheel is increased in proportion to the number. Particularly when the finishing grinding wheel which is used in the final finishing processing is largely worn, this wear tends to produce an error in the finished size. Furthermore, wear of a grinding wheel reduces the processing accuracy due to a lowered processing performance of the grinding wheel.

In order to avoid the size error and reduction of the processing accuracy, the finished size must be periodically checked to make an appropriate size adjustment. For lenses such as sunglass lenses which are processed in large quantities by the manufacturer, however, frequent size checks result in a reduced production efficiency.

SUMMARY OF THE INVENTION

In view of the problem discussed above, it is an object of the invention to provide an apparatus which can process a large number of lenses efficiently while suppressing a size error.

It is another object of the invention to provide an apparatus which can shorten the processing time period, suppress a size error due to wear of grinding wheels, and performs the processing accurately.

To achieve the above-noted objects, the present invention provides the followings:

(1) An eyeglass lens grinding apparatus for processing an eyeglass lens based on processing data obtained from target lens configuration data indicative of an eyeglass frame shape, the apparatus comprising:

lens rotating means for holding and rotating a lens;

a grinding wheel group having a finishing processing wheel for performing finishing a periphery of the lens, the finishing processing wheel having at least first and second bevel forming surfaces for forming first and second bevels on the same lens; and processing control means for controlling the finishing processing wheel to finish the lens by consecutively using the first and second bevel forming surfaces.

(2) An eyeglass lens grinding apparatus according to (1), wherein:

the finishing processing wheel includes an intermediate finishing processing wheel having the first bevel forming surface, and an accurate finishing processing wheel smaller in particle size than the intermediate finishing processing wheel and having the second bevel forming surface; and the processing control means controls the finishing processing wheel such that a surface portion of the lens, which has been processed by the intermediate finishing processing wheel, is processed by the accurate finishing processing wheel.

(3) An eyeglass lens grinding apparatus according to (2), wherein the processing control means controls the finishing processing wheel such that the surface portion of the lens, which has been processed by the intermediate finishing processing wheels, is further processed by the accurate finishing processing wheel during processing by the intermediate finishing processing wheel.

(4) An eyeglass lens grinding apparatus according to (2), wherein the processing control means sets a larger processing amount for the intermediate finishing processing wheel and a smaller processing amount for the accurate finishing processing wheel.

(5) An eyeglass lens grinding apparatus according to (2), wherein:

each of the intermediate and accurate finishing processing wheels has a plurality of beveling grooves each for forming a bevel; and the processing control means controls the finishing processing wheel to finish each of plural lenses by sequentially selected one of the beveling grooves on each of the intermediate and accurate finishing processing wheels.

(6) An eyeglass lens grinding apparatus according to (1), wherein:

the finishing processing wheel has a plurality of beveling grooves each for forming a bevel; and the processing control means control the finishing processing wheel to finish each of plural lenses by sequentially selected one of the beveling grooves on the finishing processing wheel.

(7) An eyeglass lens grinding apparatus according to (1), wherein:

each of the first and second bevel forming surfaces has surface portions having the same particle sizes; and the processing control means selectively use the first and second bevel forming surfaces so that the surface portions are worn uniformly.

(8) An eyeglass lens grinding apparatus according to (7), wherein the first and second bevel forming surfaces are provided on the same finishing processing wheel.

(9) An eyeglass lens grinding apparatus according to (1), further comprising:

correction means for correcting an error due to wear of each of the first and second bevel forming surfaces.

(10) An eyeglass lens grinding apparatus according to (1), wherein the first and second bevel forming surfaces are provided on a plurality of finishing processing wheels rotatable about different axes, respectively.

(11) An eyeglass lens grinding apparatus according to (1), wherein the finishing performed by the finishing processing wheel does noe include polishing or mirror processing.

(12) An eyeglass lens grinding apparatus according to (1), wherein the processing control means controls the finishing processing wheel such that a surface portion of the lens, which has been processed by the first bevel forming surface, is further processed by the second bevel forming surface during processing by the first bevel forming surface.

(13) An eyeglass lens grinding apparatus for processing an eyeglass lens based on processing data obtained from target lens configuration data indicative of an eyeglass frame shape, the apparatus comprising:

a finishing processing wheel having a plurality of bevel grooves each for finishing a periphery of a roughly processed lens; and a processing control unit which sequentially selects one of the bevel grooves for processing.

(14) An eyeglass lens grinding apparatus according to (13), further comprising:

a correction system which corrects an error due to wear of each of the bevel grooves of the finishing processing wheel.

According to the invention, even when a large number of lenses are processed, a size error can be reduced to a very low level and the processing can be efficiently performed.

Further, the processing time can be shortened, a size error due to wear of grinding wheels can be suppressed, and the process can be accurately performed The present disclosure relates to the subject matter contained in Japanese patent application Nos. Hei. 9-337995 and Hei. 9-337996 (both filed on Nov. 21, 1997), which are expressly incorporated herein by reference in their entireties.

BRIEF DESCRIPTION OF THE DRAWINGS

FIG. 8 is a schematic block diagram showing a control system in the lens grinding apparatus.

FIG. 9 is a diagram illustrating a calculation of a bevel employed in the lens grinding apparatus.

FIG. 10 is a view showing an example of a setting screen used when a size adjustment or the like is performed.

DESCRIPTION OF THE PREFERRED EMBODIMENT

A lens grinding apparatus according to an embodiment of the present invention will be hereinafter described with reference to the accompanying drawings.

Configuration of Whole Apparatus

Figure 1:
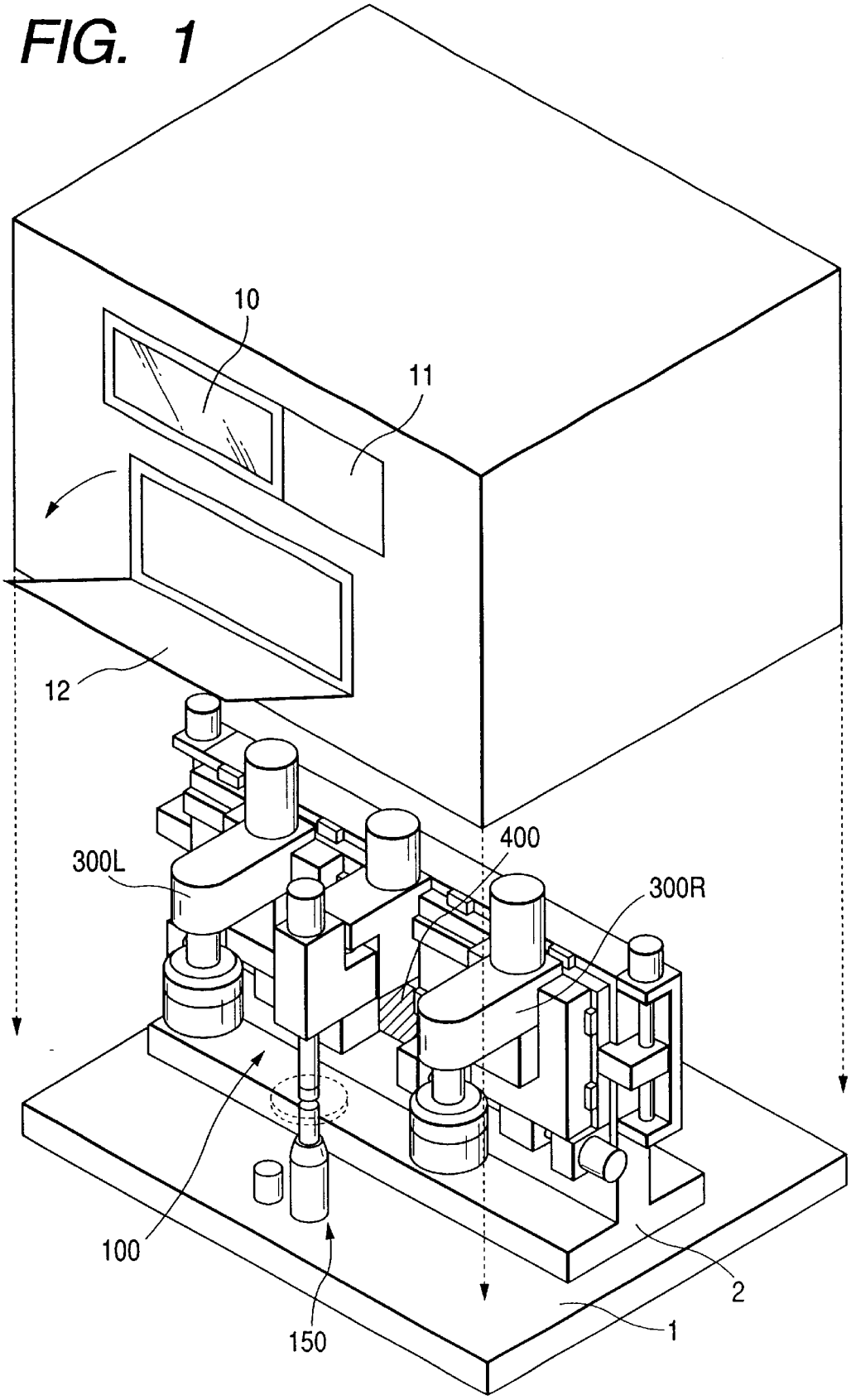
FIG. 1 is a perspective view illustrating the general configuration of a lens grinding apparatus according to an embodiment of the present invention.

In FIG. 1, reference numeral 1 denotes a main base, and 2 denotes a sub-base that is fixed to the main base 1. A lens chuck upper part 100 and a lens chuck lower part 150 hold a lens to be processed by means of their respective chuck shafts during processing it. A lens thickness (shape) measuring section 400 is accommodated below the lens chuck upper part 100 in the depth of the sub-base 2.

Figure 2:
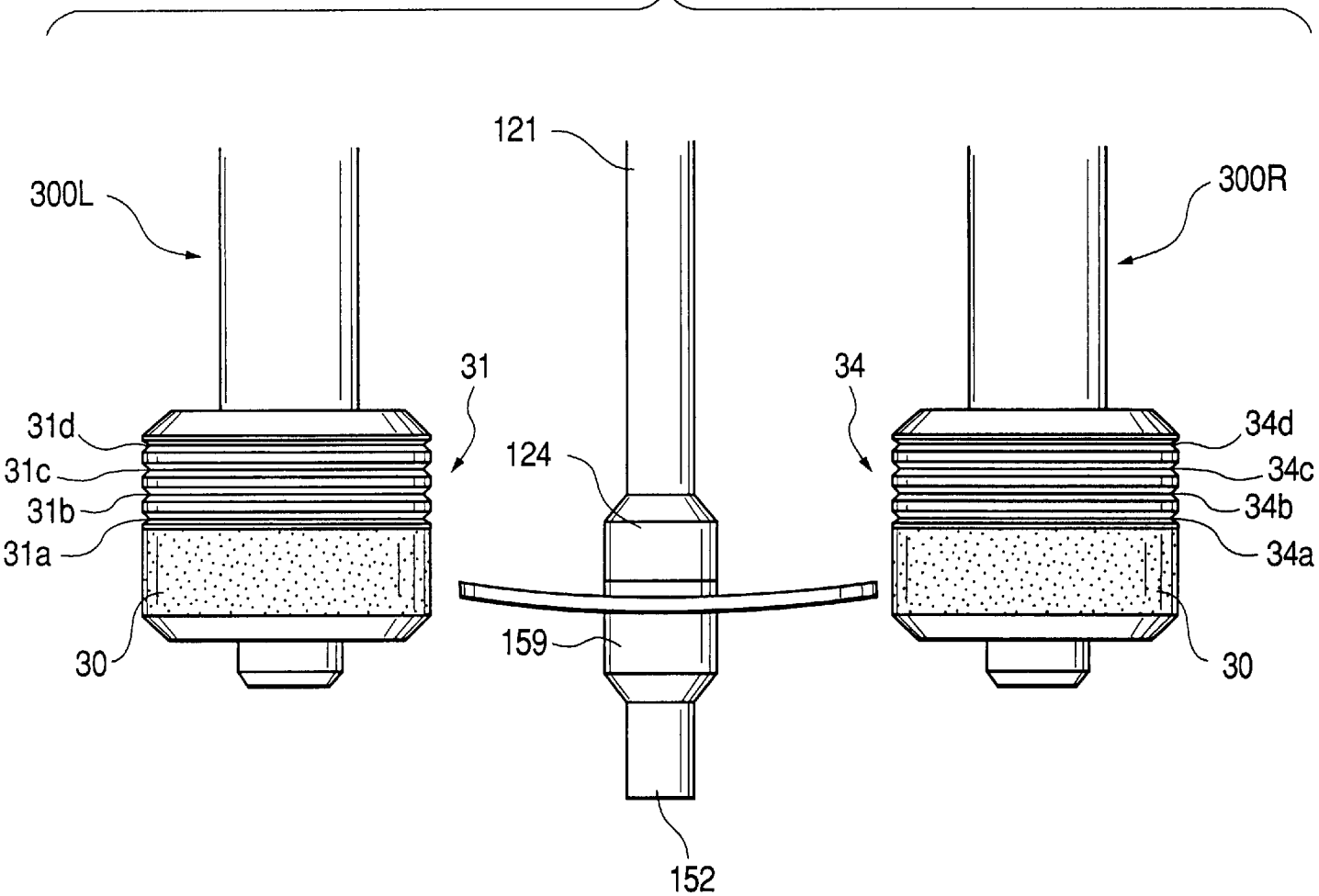
FIG. 2 is a view illustrating the configuration of grinding wheels in the lens grinding apparatus.

Reference symbols 300R and 300L respectively represent right and left lens grinding parts each having grinding wheels for lens grinding on its rotary shaft. Each of the lens grinding parts 300R and 300L is held by a moving mechanism (described later) so as to be movable in the vertical and horizontal directions with respect the sub-base 2. As shown in FIG. 2, a rough grinding wheel 30 for processing on glass lenses, and an intermediate finishing grinding wheel 31 having bevel grooves are mounted concentrically on the rotary shaft of the lens grinding part 300L. The intermediate finishing grinding wheel 31 is a metal bond grinding wheel having a particle size of #400, which is formed at its grinding surface with four bevel grooves 31*a*, 31*b*, 31*c* and 31*d* having the same V-shaped configurations. The rough grinding wheel 30 for processing on glass lenses, which is the same as that in the lens grinding part 300L, and an accurate finishing grinding wheel 34 having bevel grooves are mounted concentrically on the rotary shaft of the lens grinding part 300R. The accurate finishing grinding wheel 34 is a metal bond grinding wheel having a particle size of #600, which is formed at its grinding surface with four bevel grooves 34*a*, 34*b*, 34*c* and 34*d* having the same configurations as the bevel grooves of the intermediate finishing grinding wheel 31. The diameter of these grinding wheels are relatively small, that is, about 60 mm, thereby improving processing accuracy while ensuring durability of the grinding wheels. With this grinding wheel arrangement, the grinding apparatus is preferably used for bevelling refractive-power-less sunglass lenses made of glasses on a large or mass scale.

A display unit 10 for displaying processing data and other information and an input unit 11 for allowing a user to input data or an instruction to the lens grinding apparatus are provided in the front surface of a body of the apparatus. Reference numeral 12 denotes a closable door.

Structures of Main Parts

<Lens Chuck Part>

Figure 3:
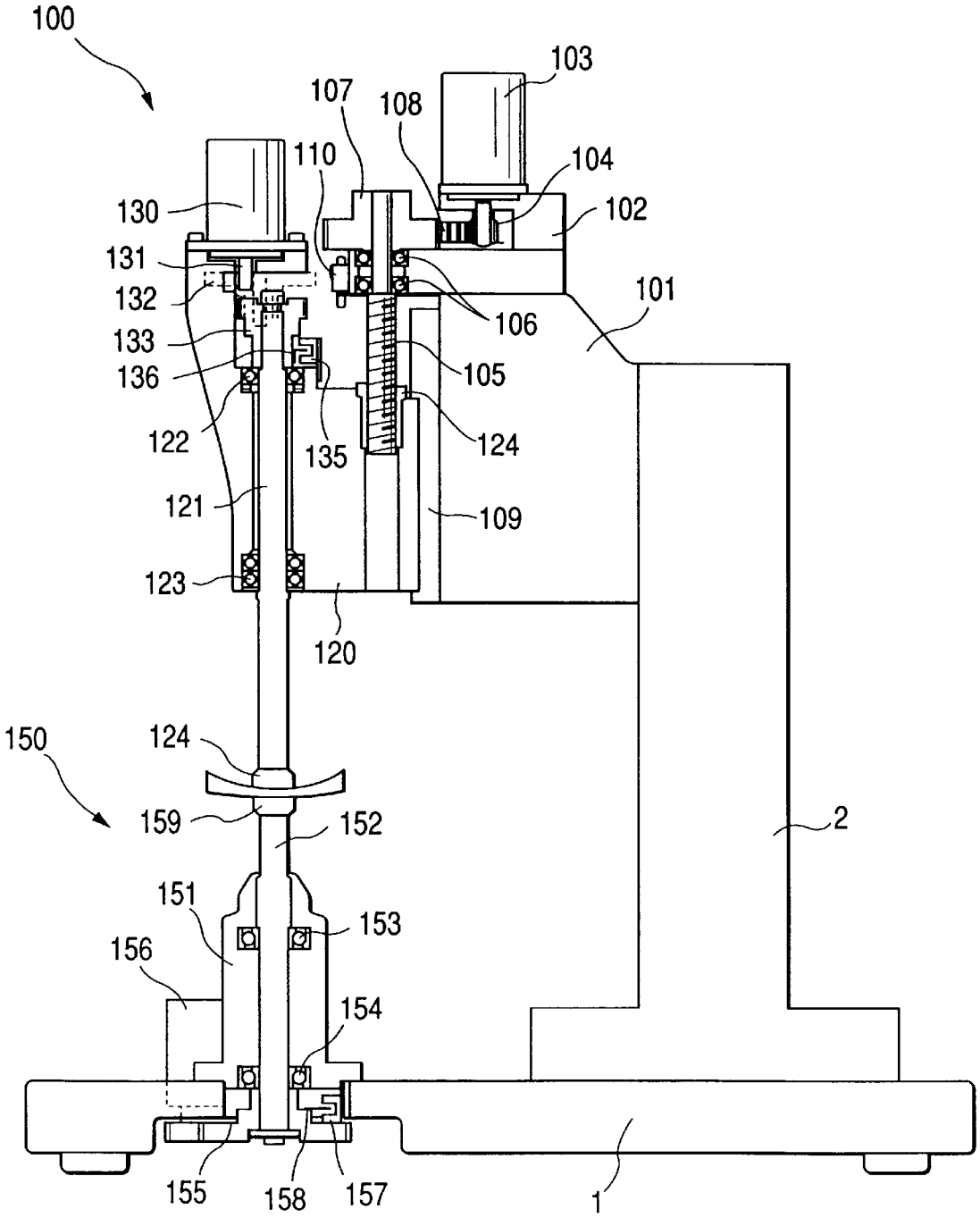
FIG. 3 is a side view showiing the upper and lower parts of a lens chuck in the lens grinding apparatus.

FIG. 3 illustrates the lens chuck upper part 100 and the lens chuck lower part 150. A fixing block 101 is fixed to the sub-base 2. A DC motor 103 is mounted on top of the fixing block 101 by means of a mounting plate 102. The rotational force of the DC motor 103 is transmitted through a pulley 104, a timing belt 108 and a pulley 107 to a feed screw 105. As the feed screw 105 is rotated, a chuck shaft holder 120 is moved vertically while being guided by a guide rail 109 fixed to the fixing block 101. A pulse motor 130 is fixed to the top portion of the chuck shaft holder 120. The rotational force of the pulse motor 130 is transmitted, via a gear 131, and a relay gear 132 to a gear 133 to rotate the chuck shaft 121. Reference numeral 124 denotes a lens depressing member mounted on the chuck shaft 121. Reference numeral 135 denotes a photosensor and 136 denotes a light-shielding plate that is mounted on the chuck shaft 121. The photosensor 135 detects a rotation reference position of the chuck shaft 121.

A lower chuck shaft 152 is rotatably held by a chuck shaft holder 151 fixed to the main base 1. The rotational force of a pulse motor 156 is transmitted to the chuck shaft 152 to rotate the chuck shaft 152. Reference numeral 159 is a cup receptacle, mounted on the chuck shaft 152, for receiving a fixing cup fixed to a lens to be processed, thereby holding the lens. Reference numeral 157 denotes a photosensor and 158 denotes a light-shielding plate that is mounted on the gear 155. The photosensor 157 detects a rotation reference position of the chuck shaft 152.

With the lens chuck part thus constructed, a lens to be processed is placed on the chuck shaft 152 side, and then chucked by lowering the chuck shaft 121. The control unit 600 (described later in detail) monitors and controls a load current of the DC motor 103 to optimize the chucking pressure.

<Moving Mechanism for Lens Grinding Part>

Figure 4:
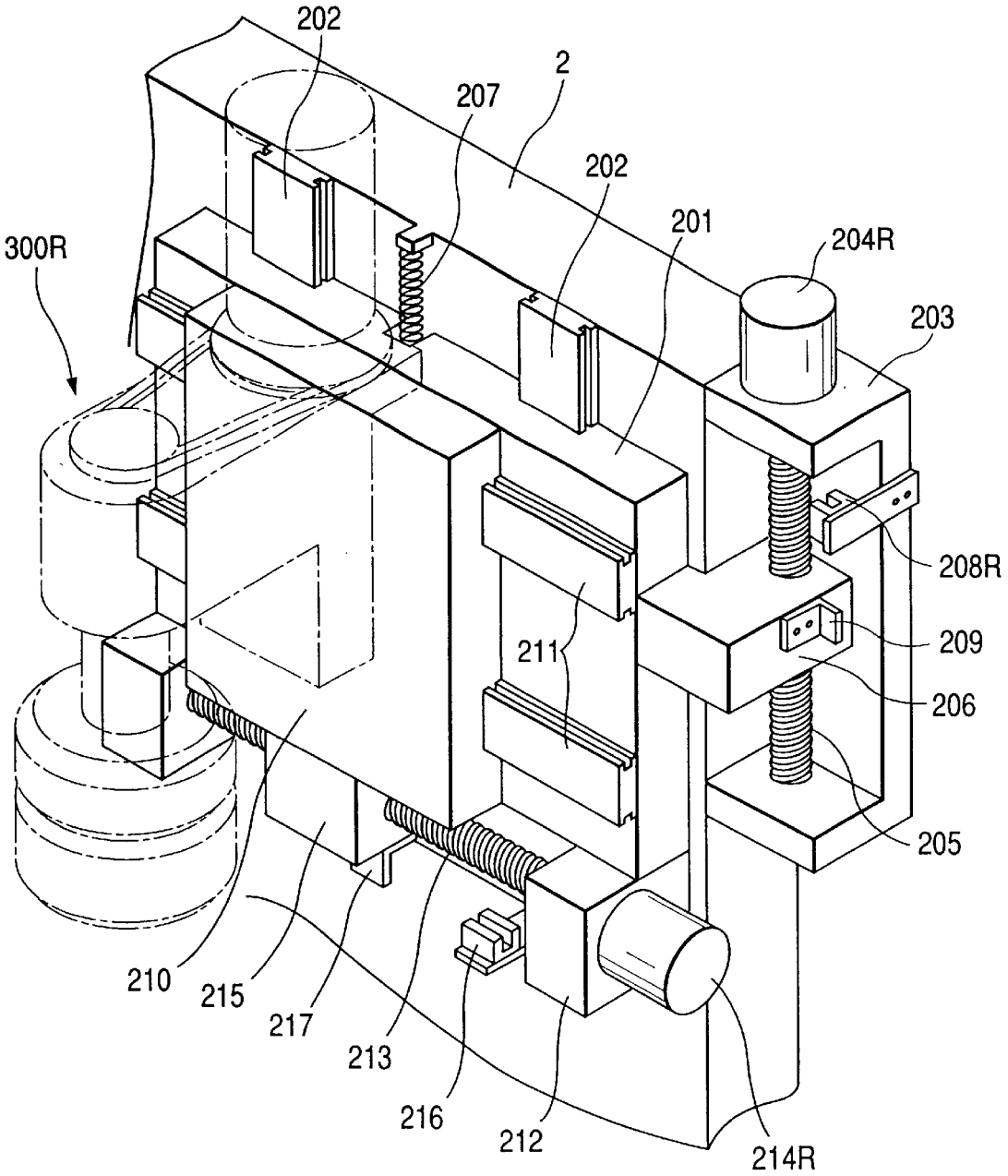
FIG. 4 is a perspective view illustrating a mechanism for moving a lens grinding part 300R.

FIG. 4 illustrates a mechanism for moving the right lens grinding part 300R. A vertical slide base 201 is vertically slidable along two guide rails 202 that are fixed to the front surface of the sub-base 2. A bracket-shaped screw holder 203 is fixed to the side surface of the sub-base 2. A pulse motor 204R is fixed to the upper end of the screw holder 203. A ball screw 205 is coupled to the rotary shaft of the pulse motor 204R, so that the rotation of the ball screw 205 causes the vertical slide base 201 fixed to a nut block 206 to be moved in the vertical direction while being guided by the guide rails 202. A spring 207 is provided between the sub-base 2 and the vertical slide base 201. That is, the spring 207 urges the vertical slide base 201 upward to cancel out the downward load of the vertical slide base 201, thereby facilitating its vertical movement. Reference numeral 208R designates a photosensor, and 209 designates a light-shielding plate that is fixed to the nut block 206. The photosensor 208R determines a reference position of the vertical movement of the vertical slide base 201 by detecting the position of the light-shielding plate 209.

Figure 5:
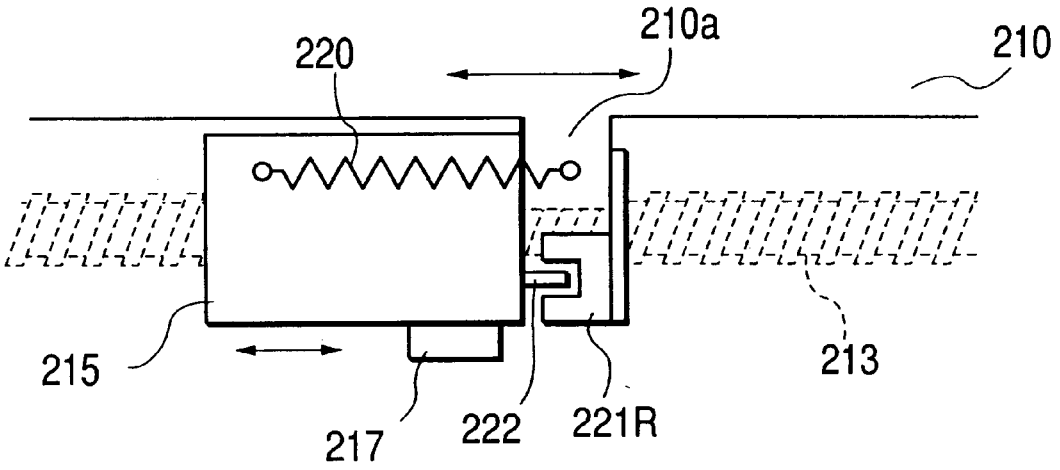
FIG. 5 is a view illustrating a mechanism for horizontally moving the lens grinding part 300R and detecting the completion of processing.

Reference numeral 210 denotes a horizontal slide base to which the lens grinding part 300R is fixed. The horizontal slide base 210 is slidable in the horizontal direction along two slide guide rails 211 that are fixed to the front surface of the vertical slide base 201. A bracket-shaped screw holder 212 is fixed to the lower end of the vertical slide base 201, and a pulse motor 214R is fixed to the side surface of the screw holder 212. The ball screw 213 is coupled to the rotary shaft of the pulse motor 214R. The ball screw 213 is in threaded engagement with a nut block 215. As shown in FIG. 5, the nut block 215 is connected through a spring 220 to a protruded portion 210*a* that extends downwardly from the horizontal slide base 210 (note that the mechanism shown in FIG. 5 is located behind the nut block 215 in FIG. 4). The spring 220 biases the horizontal slide base 210 toward the lens chuck side. The rotation of the pulse motor 214R causes the rotation of the ball screw 213, which moves the nut block 215 in the left-handed direction in FIG. 5. The horizontal slide base 210 pulled by the spring 220 is moved in the left-handed direction accordingly. If the grinding pressure larger than the biasing force of the spring 220 is caused during processing of the lens, the horizontal slide base 210 is not moved even through the nut block 215 is moved in the left-handed direction, thereby adjusting the grinding pressure to the lens to be processed. When the nut block 215 is moved in the right-handed direction in FIG. 5, the nut block 215 is pushed by the protruded portion 210*a* so as to move the horizontal slide base 210 in the right-handed direction. A photosensor 221R is attached to the protruded portion 210*a*. The photosensor 221R detects the completion of processing upon detecting a light shielding plate 222 fixed to the nut block 215.

A photosensor 216R fixed to the screw holder 212 detects a light-shielding plate 217 fixed to the nut block 215, thereby determining a reference position of the horizontal movement of the horizontal slide base 210.

Since a moving mechanism for the left lens grinding part 300L is symmetrical with that for the right lens grinding part 300R, it will not be described.

<Lens Grinding Part>

Figure 6:
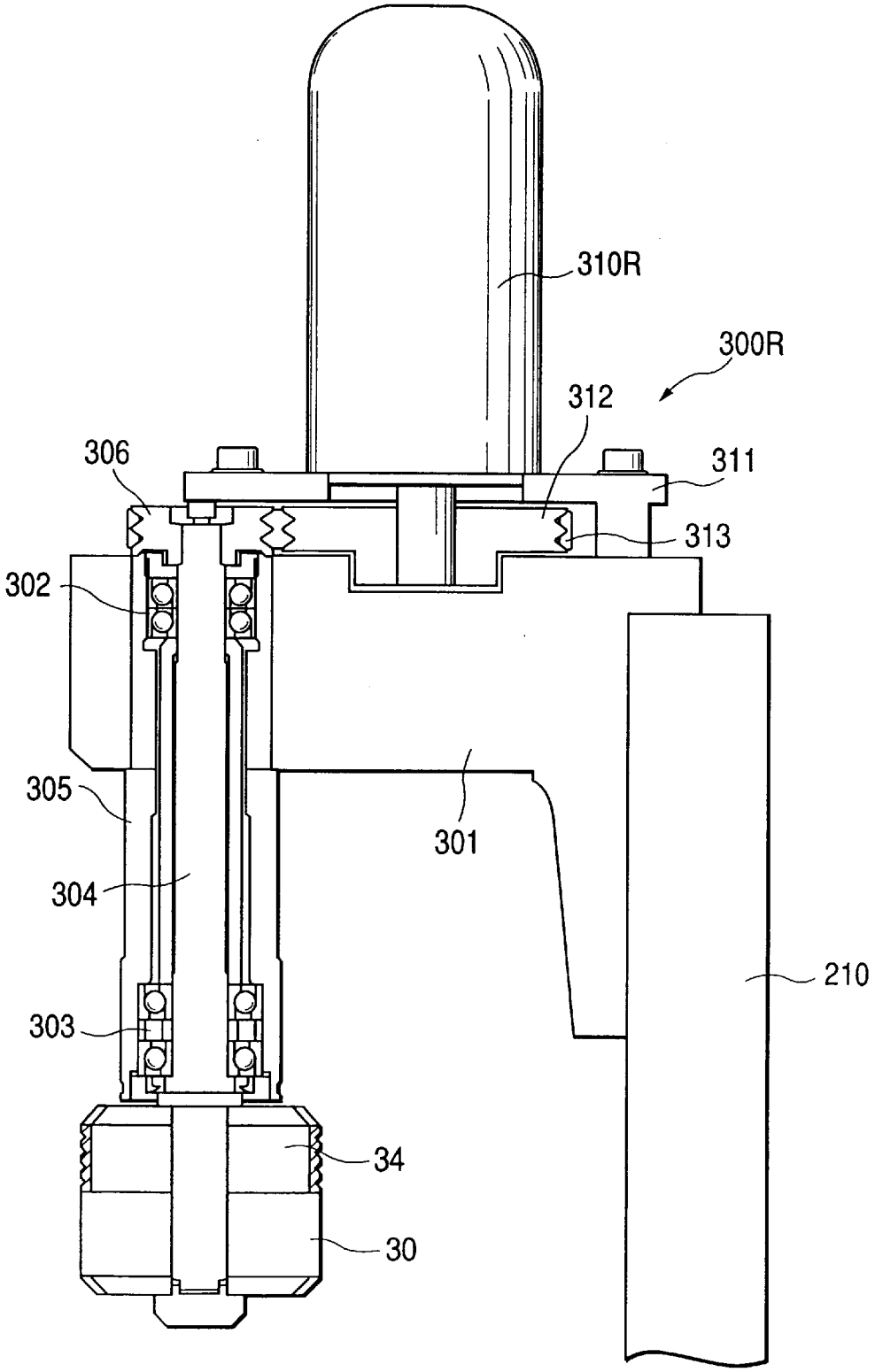
FIG. 6 is a sectional side view showing the configuration of the lens grinding part 300R.

FIG. 6 is a side sectional view showing the structure of the right lens grinding part 300R. A shaft support base 301 is fixed to the horizontal slide base 210. A housing 305 is fixed to the front portion of the shaft support base 301, and rotatably holds therein a vertically extending rotary shaft 304. A group of grinding wheels including a rough grinding wheel 30 and so on are mounted on the lower portion of the rotary shaft 304. A servo motor 310R is fixed to the top surface of the shaft support base 301 through a mounting plate 311. The rotational force of the servo motor 310R is transmitted via a pulley 312, a belt 313 and a pulley 306 to the rotary shaft 304, thereby rotating the group of the grinding wheels.

Since the left lens grinding part 300L is symmetrical with the right lens grinding part 300R, its structure will not be described.

<Lens Thickness (Shape) Measuring Section>

Figure 7:
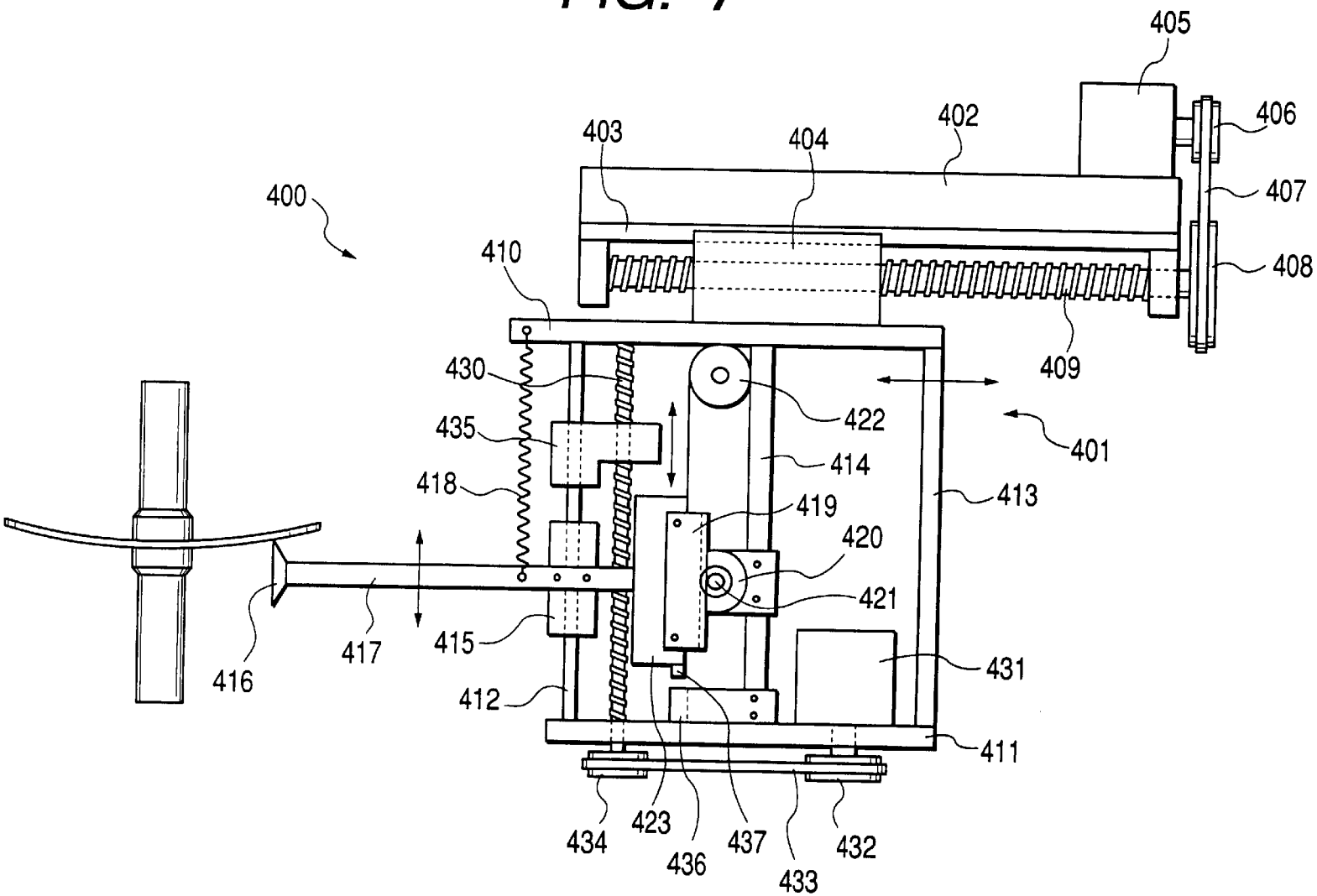
FIG. 7 is a sectional side view illustrating a lens thickness (shape) measuring section 400 in the lens grinding apparatus.

FIG. 7 is a sectional side view showing the configuration of the lens thickness (shape) measuring section 400. A lens measuring unit 401 is suspended on and held by a rail 403, attached to the lower face of a stationary base 402, through a movement block 404, so as to be slidable in the axial direction. A motor 405 for the axial movement is fixed onto the stationary base 402. The rotation of the motor 405 is transmitted via a pulley 406, a belt 407, and a pulley 408 to a feed screw 409. A female screw is formed inside the movement block 404 and threadingly engaged with the feed screw 409. The movement block 404 is moved in the axial direction by the rotation of the feed screw 409 while being guided by the rail 403.

The lens measuring unit 401 having the following configuration is attached to the lower side of the movement block 404. A guide shaft 412, a rear post 413, and a center post 414 are fixed to upper and lower plates 410 and 411. The guide shaft 412 is passed through a bearing 415 so that the bearing 415 is vertically slidable. A measurement arm 417 is fixed to the bearing 415. The measurement arm 417 has, at its distal end, a feeler 416 which is to abut against a surface of a lens to be processed. The measurement arm 417 is upward urged by a spring 418. A rack 419 is fixed via a mounting block 423 to the rear side of the measurement arm 417. A potentiometer 420 is fixed to the center post 414. A pinion 421 is attached to a rotary shaft of the potentiometer 420, and threadingly engaged with the rack 419. The potentiometer 420 detects the amount of the vertical movement of the measurement arm 417. The reference numeral 422 denotes a spring which cancels a downward load exerted on the measurement arm 417. One end of the spring 422 is fixed to the mounting block 423. A feed screw 430 is rotatably held between the upper and lower plates 410 and 411. The feed screw 430 is rotated by a motor 431 attached to the lower plate 411, via a pulley 432, a belt 433, and a pulley 434. The reference numeral 435 denotes a movement block having a female screw that is threadingly engaged with the feed screw 430. The movement block 435 is slid vertically along the guide shaft 412 in association with the rotation of the feed screw 430. The downward movement of the movement block 435 causes the lower face of the movement block 435 (on the guide shaft 412 side) to abut against the bearing 415, thereby depressing the measurement arm 417 downwardly. The initial position, i.e. the lowest position, of the measurement arm 417 is detected by means of a sensor 436 and a light shielding plate 437 fixed to the mounting block 423.

The thus configured lens thickness (shape) measuring section 400 performs a measurement in the following manner. First, the motor 405 is driven on the basis of the frame shape data of the eyeglass frame, to move the lens measuring unit 401 to a measurement position. Next, the motor 431 is rotated forwardly by a predetermined number of pulses to rotate the feed screw 430, so that the movement block 435 is moved upwardly. In asociation with this movement, the measurement arm 417 is pulled by the spring 418 to be moved upwardly, so that the feeler 416 abuts against the front surface of the lens. The movement block 435 is moved to an appropriate escape position. The lens is rotated by one turn while maintaining the abutment between the feeler 416 and the front surface of the lens, and concurrently the lens measuring unit 401 is moved in the axial direction on the basis of the frame shape data. The potentiometer 420 detects the amount of the movement of the feeler 416 in the direction of the lens chuck shaft during this operation, so that the shape of the lens is obtained.

In the lens measurement in the apparatus of the embodiment, the shape of the front surface of the lens is measured two times in accordance with different measurement paths based on the data of the eyeglass frame. From the two measurements, the inclination of the front surface of the lens at an edge position of the lens in relation to each radius vector is obtained, and the obtained inclination is used in the calculation of the bevel data (the calculation will be described later). The bevel data may be calculated by measuring the front and rear surfaces of the lens, and feelers which are respectively dedicated to the front and rear surfaces of a lens may be dispose, as disclosed in Japanese patent Kokai publication No. Hei. 3-20603, and others. In the case of a refractive-power-less sunglass lense configured by a complete spherical surface, if data of one point (for example, a point on the bevel bottom face) are obtained in relation to each radius vector, it is possible to attain necessary accuracy. For example, if the spherical curve is calculated or obtained as data, the inclination of the surface at the bevel position can be obtained.

<Control System>

FIG. 8 is a block diagram showing a general configuration of a control system of the lens grinding apparatus. Reference character 600 denotes a control unit which controls the whole apparatus. The display unit 10, input unit 11, and photosensors are connected to the control unit 600. The motors for moving or rotating the respective parts are connected to the control unit 600 via drivers 620–628. The drivers 622 and 625, which are respectively connected to the servo motor 310R for the right lens grinding part 300R and the servo motor 310L for the left lens grinding part 300L, detect the torque of the servo motors 310R and 310L during the processing, and feed back the detected torque to the control unit 600. The drive 628 detects the load current of the DC motor 103, and feeds back the detected current to the control unit 600. The control unit 600 uses these information to control the movement of the lens grinding parts 300R and 300L, the rotation of the lens, and the lens chuck pressure.

Reference numeral 601 denotes an interface circuit which serves to transmit and receive data. An eyeglass frame shape measuring apparatus 650 (see U.S. Pat. No. 5,333,412), a host computer 651 for managing lens processing data, a bar code scanner 652, etc. may be connected to the interface circuit 601. A main program memory 602 stores a program for operating the lens grinding apparatus. A data memory 603 stores data that are supplied through the interface circuit 601, lens thickness measurement data, and other data.

Operation

The operation of the thus configured apparatus will be described. Hereinafter, the operation in the case where a large number of sunglass lenses with no refractive power and of the same specifications are processed into the same shape will be described.

The shapes of various eyeglass frames into which the sunglass lenses are to be fitted (hereinafter, such a shape is referred to as "a target lens configuration") are previously measured by a lens frame shape measuring apparatus 650, and the target lens configuration data are transmitted to a host computer 651. The target lens configuration data are managed by the host computer 651. The data relating to a lens shape, such as the thickness of a lens are managed by the host computer 651. When the lens processing is to be performed, a job card in the form of a bar code, which is attached to the lens to be processed, is read by a bar code scanner 652 connected to the present apparatus (the job card in the form of the bar code is attached in the unit of a lot in which a large number of lenses to be processed into the same frame and having the same specification are bundled). According to the instruction of the job card, the data relating to the lens shape, such as the thickness of each lens, and the target lens configuration data are read out from a management database of the host computer 651, and then transferred to and stored in a data memory 603.

When a processing is to be initially performed by using the transferred target lens configuration data, the switch lle of the input unit 11 is operated so that the measurement mode is switched to "lens measurement" mode. When a lens to be processed is placed on the side of the chuck shaft 152 and the start switch 11*i* is depressed, the chuck shaft 121 is lowered so that the lens is chucked, and the lens measurement is then started.

The control unit 600 operates the lens thickness (shape) measuring section 400 on the basis of the target lens configuration data, so that the shape of the front surface of the lens is measured. Along two-dimensional first and second measurement paths obtained based on the target lens configuration (eyeglass frame shape) data, measurement is performed twice on the front face of the lens. For example, the first measurement path is set to be at the position of a bevel apex which is the outermost peripheral portion of the lens, and the second measurement path is set to be a path located inwardly from the bevel apex by an amount corresponding to the bevel height (i.e. an amount corresponding to the depth of the bevel groove in each of the intermediate and accurate finishing grinding wheels 31 and 34).

The calculation of the bevel will be described. When a bevel is to be formed in a sunglass lens of a constant thickness and having no refractive power, the present embodiment adopts such a processing by which the bevel apex is located at a substantially center position of the thickness of the lens periphery (edge), in order to visually improve the bevel state. If a lens has no curve, the lens, which has undergone the processing and is to be subjected to the beveling, has a constant peripheral (edge) thickness. However, a lens for a sunglass has a curve, and hence the peripheral (edge) thickness of the lens is thicker as the lens surface is more inclined. On the basis of the peripheral (edge) positions of the first and second measurement paths and the thickness of the lens center, the bevel calculation produces data in which the thickness variation is corrected, thereby obtaining bevel path data. Specifically, as shown in FIG. 9, using the points A and B obtained as results of two lens measurements, the lens surface between the points A and B is approximated as a linear line, and the inclination $\theta$ of the lens front surface at the lens periphery after processing is obtained. In accordance with the inclination $\theta$ of the lens front surface, a correction factor is previously determined. The position of the bevel apex can be obtained from the position of the first measurement path with the use of the correction factor. Accordingly, the bevel apex path data can be obtained.

Alternatively, the bevel apex path data may be obtained in the following manner. When the subject lens has a constant thickness, the inclination of the front surface of the lens is equal to that of the rear surface, and hence the thickness t' of the periphery (edge) which located inwardly from the bevel apex by an amount corresponding to the height of the bevel can be easily obtained from the following expression in relation to the lens thickness t (for example, 2.2 mm):

$$t'=t/\cos\theta.$$

When the peripheral (edge) thickness based on of the target lens configuration data is obtained in relation to each radial vector angle, the path data of the bevel apex which is to be located at the center of the peripheral (edge) thickness are obtained.

The bevel path data thus obtained are converted into data on the axis-to-axis distance between the lens rotary shaft and the grinding wheel rotary shaft to provide processing data for the lens processing. The processing data are stored into the data memory 603, and readout therefrom and used during the processing.

Subsequently to the completion of the lens measurement operation of the apparatus, the "lens measurement" mode is canceled by operating the switch lle so that the mode is transferred to the processing mode. By depressing the start switch lli, the processing is started. The mode changeover signal and the start signal may entered as instruction signals in association with a key operation on the host computer 651 in place of an operation of the switches of the input unit 11.

In response to the processing start signal, the rough processing is first performed. The control unit 600 drives the servo motors 310R and 310L to rotate both the groups of grinding wheels of the lens grinding parts 300R and 300L. Furthermore, the control unit 600 drives the right and left pulse motors 204R and 204L to lower the right and left vertical slide bases 210 so that both of the right and left rough grinding wheels 30 are located at the same height as the lens to be processed. Then, the pulse motors 214R and 214L are rotated so as to slide the lens grinding parts 300R and 300L toward the lens, and the upper and lower pulse motors 130 and 156 are synchronously rotated so that the lens chucked by the chuck shafts 121 and 152 are rotated. The right and left rough grinding wheels 30 are moved toward the lens while being rotated, thereby gradually grinding the lens from the two directions. The amounts of movement of the rough grinding wheels 30 toward the lens are controlled independently from each other on the basis of the processing data. In the apparatus of the embodiment, since the axis of the lens chuck shaft is aligned on a linear line connecting the axes of the rotary shafts for the right and left grinding wheel groups, the right and left rough grinding wheels 30 are moved on the basis of the shape information sets which are shifted from each other by 180 degrees.

Subsequently to the completion of the rough processing, a bevel finishing processing using the intermediate finishing grinding wheel 31 and the accurate finishing grinding wheel 34 is started. The control unit 600 causes the rough grinding wheels 30 to be separated from the lens, then reads the bevel processing data stored in the data memory 603, and, on the basis of the data, moves the lens grinding parts 300L and 300R so that one of the four bevel grooves of each of the intermediate finishing grinding wheel 31 and the accurate finishing grinding wheel 34 is located at the position of the bevel which is to be formed in the lens. In a case of the processing of the first subject lens, the bevel grooves 31*a* and 34*a* are used. The control unit 600 controls the rotating intermediate finishing grinding wheel 31 to be moved toward the lens, so that the bevel groove 31*a* is pressingly contacted with the lens to grind the lens. Subsequently to the completion of the intermediate-finishing at the initial rotational position (i.e., after a portion of the lens at the initial rotational position has be ground until an amount for the accurate finishing remains), the rotation of the lens is started. During the rotation of the lens, the intermediate finishing processing is performed on the whole periphery of the lens by moving the intermediate finishing grinding wheel 31 on the basis of the bevel processing data for intermediate finishing. In the course of the semi-finishing processing, when the lens makes one half of rotation, the accurate finishing grinding wheel 34 is moved toward the lens and the portion of the lens which has been subjected to the intermediate finishing processing is further subjected to the accurate finishing processing using the bevel groove 34*a*. On the basis of the bevel processing data for accurate finishing processing, the control unit 600 controls the movement of the accurate finishing grinding wheel 34 in the axial direction and the direction toward the lens until the lens is completely processed. In this operation, it is preferable to set the processing amount (about 0.2 mm) of the accurate finishing process to be smaller than the processing amount (about 1.5 mm) of the intermediate-finishing processing. In the case of the sunglass lens of a thickness of 2.2 mm, even if the lens is not ground to completely remove the amount set for the intermediate finishing processing, the accurate finishing grinding wheel 34 can complete the required processing for the lens by one rotation of the lens. In other words, the whole of the required finishing processing including the accurate finishing can be ended upon the total 1.5 rotations of the lens.

By subjecting the portion of lens to the intermediate finishing processing and then to the accurate finishing processing using the accurate finishing grinding wheel of a smaller particle size as described above, it is possible to provide an excellent finished surface without any burrs which are likely to be formed on the lens periphery (edge) in the case of a glass lens. The accurate finishing process may be started after the previous intermediate finishing process is ended over the whole periphery of lens. However, the start of the accurate finishing processing from a time point, at which a portion of the lens, that has been subjected to the intermediate finishing processing, reaches the position where accurate finishing processing is enabled, makes it possible to shorten the entire processing time period, and thus the efficient finishing processing can be attained. Specifically, in the case where the processing using the accurate finishing grinding wheel is started after the intermediate finishing processing is ended completely over the whole periphery of the lens, at least two rotations of lens are required. In contrast, according to the grinding wheel arrangement of the embodiment, only 1.5 rotations of lens can complete the entire finishing processing in the fastest case as described above.

Since the finishing processing is divided into two steps, i.e. the intermediate finishing processing and the accurate finishing processing, wear of grinding wheels can be dispersed. Further, since the amount to be processed by the final, accurate finishing processing can be reduced, the wear amount of the accurate finishing grinding wheel 34 is smaller in degree than that of the intermediate finishing grinding wheel 31. Even when a large number of lenses are continuously processed, the reduction of the size accuracy due to wear of the grinding wheels can be suppressed to a very low level. The experiments conducted by the inventors indicated that the wear amount of the intermediate finishing grinding wheel was about 0.05 mm and that of the accurate finishing grinding wheel was not larger than about 0.01 mm when about 1,000 lenses were processed under a condition that the processing amount of 1.5 mm was set for the intermediate finishing grinding wheel and the processing amount of 0.2 mm was set for the accurate finishing grinding wheel was 0.2 mm. Namely, it was confirmed that the size accuracy can be sufficiently maintained.

When the processing for one lens is ended as described above, the chuck shaft 121 is raised and the processed lens is detached. Thereafter, the control is transferred to the processing for the next lens. The control unit 600 reads out the previously stored processing data, and performs the rough and finishing processings in the processing mode without the lens measurement. Thus, in comparison to the case in which the lens measurement is performed for each lens, the entire processing time period can be shortened. The processing for sunglass lenses is generally performed such that a large number of lenses of the same specifications are continuously processed using the same target lens configuration. Consequently, the omission of the lens measurement can largely shorten the entire processing time period.

The host computer 651 may store and manage plural sets of processing data together with identification symbols, in correspondence with lens specification data and target lens configuration data. In this case, even if the lot of lenses is changed, the host computer 651 can read out processing data corresponding to instructions on a bar code job card to continuously perform the processing in the process mode without the lens measurement. However, it is not required to store plural sets of processing data. Note that since the processing for sunglass lenses is generally performed such that a large number of lenses of the same specifications are continuously processed using the same target lens configuration as described above, the lens measurement at each time when a different processing is to be performed does not lead a serious time loss, so that the storing of the plural sets of processing data is not essential and the rewriting of the processing data at each time when a different processing is to be performed is sufficient.

In the finishing processing for the second lens after the rough processing, the control unit 600 controls the apparatus so that the finishing processing is performed using the bevel groove 31*b* of the intermediate finishing grinding wheel 31 and the bevel groove 34*b* of the accurate finishing grinding wheel 34. Each time when the lens is changed to another one, the bevel grooves to be used in the processing are sequentially changed accordingly. That is, the bevel grooves 31*c* and 34*c* are used in the processing for the third lens, and the bevel grooves 31*d* and 34*d* are used in the processing for the fourth lens. In the embodiment, this can reduce the wear of the grinding wheels to one fourth in comparison to the case in which only one bevel groove is used in the processing. Thus, the life of the grinding wheels can be prolonged. Even when a large number of lenses are continuously processed, the lowering of the size accuracy can be avoided as much as possible.

The finished size of a lens may be gradually increased because of wear of the grinding wheels due to repeated processings, or other reasons. The size adjustment is conducted in the following manner. The menu switch 11*d* is depressed so that a parameter setting screen 700 shown in FIG. 10 is displayed on the display unit 10. The item which is to be adjusted is selected by moving an arrow cursor 701 which is displayed in the left side of the screen. The items correspond to the four bevel grooves 31*a* to 31*d* of the intermediate finishing grinding wheel 31 and the four bevel grooves 34*a* to 34*d* of the accurate finishing grinding wheel 34, respectively. Any one of the bevel grooves can be selected. The preset size of the selected item is changed by increasing or decreasing the value displayed in the right side, by operating the switch 11*c*. Similarly, the bevel positions of the intermediate finishing grinding wheel 31 and the accurate finishing grinding wheel 34 can be adjusted for the bevel grooves independently from one another. When the parameter setting screen 700 is closed, the data stored in the adjust value memory 604 are rewritten by the adjusted values. The input of these values may be realized by a control from the host computer 651 connected to the main unit of the apparatus. The control unit 600 controls the processing by each bevel groove on the basis of the rewritten data. This enables an appropriate setting to cope with the wear of the grinding wheels even if the bevel grooves have different degrees of grinding wheel wear.

The present invention has been described by referring to a processing for a sunglass lens with no refractive power. The present invention can also be applied to a processing for an eyeglass lens with a refractive power since the eyeglass lenses with the refractive power can be processed similarly.

What is claimed is:

1. An eyeglass lens grinding apparatus for processing an eyeglass lens based on processing data obtained from target lens configuration data indicative of an eyeglass frame shape, said apparatus comprising:

lens rotating means for holding and rotating a lens;

a finishing abrasive wheel section for forming a bevel on a peripheral surface of the lens that has been roughly processed said finishing abrasive wheel section excluding a polishing wheel and having a plurality of beveling grooves, each of said plurality of beveling grooves having the same configuration but having a different particle size;

memory means for storing respective positions of the beveling grooves; and processing control means for performing beveling for a single lens first with a first beveling groove selected from said plurality of beveling grooves and having a larger particle size and then with a second beveling groove selected from said plurality of beveling grooves and having a smaller particle size.

2. An eyeglass lens grinding apparatus according to claim 1, wherein:

said finishing abrasive wheel section includes an intermediate finishing abrasive wheel having said first beveling groove having the larger particle size and an accurate finishing abrasive wheel having said second beveling groove having the smaller particle size, and wherein said processing control means controls said finishing abrasive wheel section such that the lens, which has been processed by said intermediate finishing abrasive wheel, is processed by said accurate finishing abrasive wheel.

3. An eyeglass lens grinding apparatus according to claim 2, wherein said processing control means controls said finishing abrasive wheel section such that a surface portion of the lens, which has been processed by said intermediate finishing abrasive wheel, is further processed by said accurate finishing abrasive wheel in parallel during processing by said intermediate finishing abrasive wheel.

4. An eyeglass lens grinding apparatus according to claim 2, wherein said processing control means sets a larger processing amount for said intermediate finishing abrasive wheel and a smaller processing amount for said accurate finishing abrasive wheel.

5. An eyeglass lens grinding apparatus according to claim 2, wherein:

said intermediate finishing abrasive wheel has a plurality of beveling grooves the same in configuration and particle size as the first beveling groove, and the accurate finishing abrasive wheel has a plurality of beveling grooves the same in configuration and particle size as the second beveling groove.

6. An eyeglass lens grinding apparatus according to claim 5, wherein said processing control means selects one from said beveling grooves having the same configuration and the same particle size in a predetermined sequential order for beveling lenses of the same lens material.

7. An eyeglass lens grinding apparatus according to claim 1, wherein:

said finishing abrasive wheel section has a plurality of beveling grooves the same in configuration and particle size as one of said beveling grooves that are different in particle size.

8. An eyeglass lens grinding apparatus according to claim 7, wherein said processing control means selects one from said beveling grooves having the same configuration and the same particle size in a predetermined sequential order for beveling lenses of the same lens material.

9. An eyeglass lens grinding apparatus according to claim 1, further comprising:

correction means for correcting an error in lens bevel configuration due to wear of each of said beveling grooves.

10. An eyeglass lens grinding apparatus according to claim 2, wherein said intermediate finishing abrasive wheel and said accurate finishing abrasive wheel are rotated about respective different axes.

11. An eyeglass lens grinding apparatus according to claim 1, wherein said processing control means sets a larger processing amount for a beveling groove having a larger particle size, and a smaller processing amount for a beveling groove having a smaller particle size.

12. An eyeglass lens grinding apparatus according to claim 1, wherein said processing control means controls an axis-to-axis distance between a lens rotation axis and an abrasive wheel rotation axis, and a relative position of the beveling grooves with respect to the lens in a direction of the lens rotational axis.

13. An eyeglass lens grinding apparatus for processing an eyeglass lens based on processing data obtained from target lens configuration data indicative of an eyeglass frame shape, said apparatus comprising:

a finishing abrasive wheel for forming a bevel on a periphery of a roughly processed lens, the finishing abrasive wheel being designed for the same lens material and having a plurality of beveling grooves having the same configuration and particle size;

memory means for storing respective positions of said beveling grooves; and processing control means for selecting one from said beveling grooves in a predetermined sequential order for beveling lenses of the same lens material.

14. An eyeglass lens grinding apparatus according to claim 13, further comprising:

correction means for correcting an error in lens bevel configuration due to wear of each of said beveling grooves.

15. An eyeglass lens grinding apparatus according to 13, wherein the lenses of the same lens material include glass lenses.

16. An eyeglass lens grinding apparatus for processing an eyeglass lens based on processing data obtained from target lens configuration data indicative of an eyeglass frame shape, said apparatus comprising:

a lens rotating device which holds and rotates a lens;

a finishing abrasive wheel section for forming a bevel on a peripheral surface of the lens that has been roughly processed, said finishing abrasive wheel section excluding a polishing wheel and having at least a plurality of beveling grooves, each of said plurality of beveling grooves having the same configuration but having a different particle size;

memory which stores respective positions of the beveling grooves; and a processing controller which performs beveling for a single lens first with a first beveling groove selected from said plurality of beveling grooves and having a larger particle size and then with a second beveling groove selected from said plurality of beveling grooves and having a smaller particle size.

* * * * *